United States Patent [19]

Gomoll et al.

[11] Patent Number: 4,834,277

[45] Date of Patent: May 30, 1989

[54] PAPER FEEDING IN PRINTERS

[75] Inventors: Guenter Gomoll, Nersingen/Leibi; Wolfgang Hauslaib, Langenau, both of Fed. Rep. of Germany

[73] Assignee: Mannesmann AG, Duesseldorf, Fed. Rep. of Germany

[21] Appl. No.: 21,454

[22] Filed: Mar. 4, 1987

[30] Foreign Application Priority Data

Mar. 4, 1986 [DE] Fed. Rep. of Germany ..... 3607079

[51] Int. Cl.[4] ..... B65H 17/10; B41J 13/00

[52] U.S. Cl. ..... 226/101; 226/187; 226/193; 226/74; 400/605; 400/616

[58] Field of Search ..... 226/74, 109, 110, 176, 226/180, 186, 187; 400/616, 616.1, 616.2, 616.3

[56] References Cited

U.S. PATENT DOCUMENTS 3,330,458 7/1967 Bentzman ..... 226/187 X
3,561,660 2/1971 Nicol ..... 226/187
3,753,483 8/1973 Londquist et al. ..... 400/616.1 X
4,272,001 6/1981 Horniak ..... 226/193 X
4,564,305 1/1986 Rekewitz et al. ..... 400/616.1 X
4,606,663 8/1986 Christoph et al. ..... 400/616 X

FOREIGN PATENT DOCUMENTS 0123310 10/1984 European Pat. Off. ..... 400/616.1

*Primary Examiner*—Stuart S. Levy
*Assistant Examiner*—Steven M. DuBois
*Attorney, Agent, or Firm*—Ralf H. Siegemund

[57] ABSTRACT

The paper feeder incudes an upstream friction roller pair for single sheet feeding, a pushing tractor for endless sheet feeding, and a common downstream (behind the platen) friction roller pair. Each pair has one roller mounted on a pivot lever and the two levers linkedly held in a spring biased linkage such that consistently the downstream roller pair exert a smaller friction force while rotating at a higher speed.

9 Claims, 2 Drawing Sheets

PAPER FEEDING IN PRINTERS

BACKGROUND OF THE INVENTION

The present invention relates to paper feeding in printer and particularly to the transport of single sheets as well as continuous endless sheet feeding particularly, into a matrix printer which printer includes a printing platen and friction rollers with an additional feature of providing a traction device for endless sheet feeding.

Generally speaking, the paper transport device in a matrix printer must be adapted to feed into the printer single sheets, on an individual basis, but it must also be equipped for continuous sheet feeding that is to say it must also feed endless sheets having for example, special perforations along the margin. For this, one provides usually a tractor downstream from the printing area, to pull the endless sheet through the printer. The initial threading of the individual sheets as well as the endless sheets, the merging of the feed channels and subsequent processing that includes printing in a continuous mode or by step by step advance has to be carried out without incurring problems such as paper bunching and other interference. Compounded is the problem by the fact that for example, the individual sheets or the endless sheet may have, at times, different formats. Known here is, for example, the special requirement for ticket printing such as the printing of airline tickets or the printing of checks, of customer's receipts, of labels and so forth.

The feeding, printing and removal of such print stock, be it individual sheets or an endless sheet, moreover, does pose a variety of specific problems. For example, depending upon the position of the drives in the beginning, it may be require to waste certain amount of paper and to pass through the system, at first, an empty page or some empty sheets or parts thereof. Another problem is that the drives may cause the paper to bulge or bunch for a variety of reasons, the paper is longer taut all the way through and that, in turn, can lead to bunching and ultimately to just stopping of the printer. More recently, another requirement has been added to the paper transport device in such a printer, namely the possibility of retracting the paper if, for some reason, it is discovered that the wrong kind has been used and a different type or kind of paper should be used instead. Thus, ripping the wrong sheets out of the printer is not only primitive but wasteful but ultimately may add to down time.

DESCRIPTION OF THE INVENTION

It is an object of the present invention to improve the threading, guidance and discharge of paper in a printer, to avoid the aforementioned problem and to permit, in addition, the controlled retraction of a sheet, quite independent from an initial selection whether or not individual sheets or endless sheets have been used or are going to be used. In addition, a more economic use of paper particularly during the initial and threading-in phase is to be considered in order to avoid particularly empty sheets or sheet portions in the initial phase of printing.

In accordance with the preferred embodiment of the present invention, it is suggested to provide a feed in friction roller pair for single sheet feeding just in front of i.e. upstream from the platen and to provide a thrust or pushing tractor for purposes of endless sheet feeding, also upstream and operationally in parallel to the friction roller pairs; and that downstream from the printing platen, a second friction roller pair is provided; one of the rollers of each pair is stationarily journalled in the printer frame and the respective other friction roller is liftable but can be adjusted to exert a predetermined pressure force towards and against the respective associated stationarily mounted friction roll pertaining to the same pair, whereby the friction forces, thus exerted, bear a particular relation, the downstream roller force is smaller than the upstream roller force.

This arrangement offers the following advantages: Feeding of endless sheet stock as well as individual sheets in both instances is carried out by pushing rather than pulling while only the retraction, if necessary, but also the forward discharge of the individual paper sheets or of the endless sheet is carried out by pulling. The configuration of the endless sheet advancing device as a thrust or pushing tractor means that on the discharge and upstream side space is saved at and around the discharge friction roller pair to that paper losses will not occur. Moreover, this arrangement insures the shortest possible distance between the point of printing and the discharge friction roller pair. This latter feature, in turn, means that a brief of paper sheet from the printing position is now quite possible. Following discharge through the friction roller pair at the exit or the discharge side, a single sheet can be torn from the endless web with relative ease without requiring the refeeding of the paper by hand or automatically. If in the case of printing on multi-layer forms certain waves or bulges occur or even an outright stoppage, one can simply open, so to speak, the friction roller pairs and remove the bunched paper. Another advantage is that predetermined and mutually depending pressure forces of the two friction roller pairs permit adjusting to the desired degree of traction needed for pushing and pulling in each instance, particularly on an individual basis as far as the respective sheets are concerned. The paper is therefore always taut and smooth right in front of the printing platen. The inventive paper transport device is particularly of advantage for bar-shaped printing platens having a linear area of printing, but the still more common cylindrical platens can likewise be used.

In furtherance of the invention, it suggested to provide the liftable friction rolls in each instance on a lever being constructed as a pivot lever. The pivot lever pertaining to the roller pair downstream from the platen should be mounted on an axis running parallel to the axis of the platen, which axis is provided with at least one cam-like section which is also mounted to a resiliently biased lever. The latter is provided to hold the roller carrying lever. In furtherance of the invention, an intermediate lever is pivotally mounted to the frame of the printer and supports one legs of a U-shape spring whose other leg bears against the aforementioned resiliently biased lever that holds the shaft for the roller mounting lever such that the shaft with the roller mounting lever can rotate relative to the intermediate lever. This way one provides a toggle lever-like linkage between on one hand the downstream friction roll carrying lever and the resilient lever as well as the intermediate lever. The intermediate lever provides a connecting point for a tension spring which has its other end connected to the upstream friction roll carrying lever. Thus, this way also the upstream lever is spring biased and is held in operating position on a continuous basis and in particular relation to the downstream lever.

It is of advantage to particularly proportion the pressure forces as between the rollers of each roller pair. This carried out by selecting the respective lever lengths as well as by selecting the force of the springs such that the force of the downstream rollers to the force of the upstream rollers has a ratio of about 1 to 1.4. Owing to this differential, it was found that threading in as well as retraction either of an endless as well as of a single sheet is greatly facilitated. The desired friction forces can an addition be accurately predetermined in that one of the friction roller pair is comprised of one steel roller and one roller that is carries rubber layer, instead of a steel roller, one can use a smooth surface roller of a hard synthetic material. Conceivably, all of the rollers are drivable. In the case of the synthetic material for at least one of the roller, it might be of advantage to pendulum swing mount that roller. Finally, it should be mentioned that details of paper guiding are shown in our copending application (attorney's docket No. MM/K757-s) the content of which is fully incorporated by reference, though not essential for understanding the present invention.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

DETAILED DESCRIPTION OF THE DRAWINGS

Figure 1:
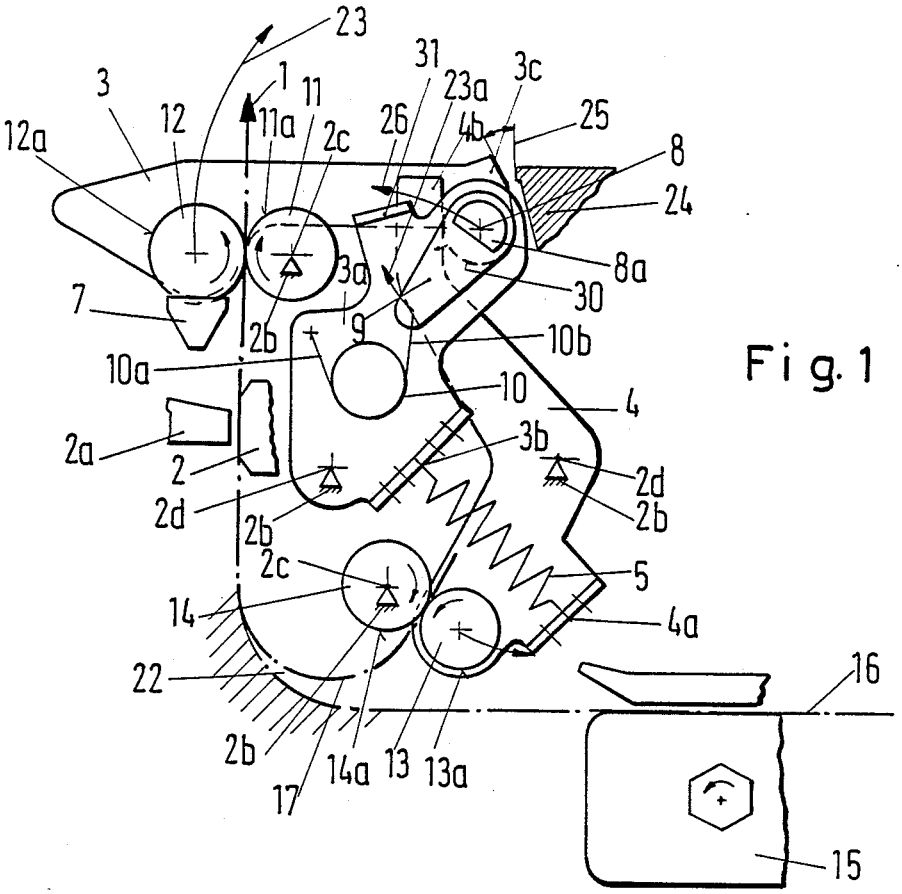
FIG. 1 is a side view through a paper feed and transport device in a matrix printer whereby only those portions relevant to the paper feeding and transport are illustrated.

In FIG. 1, the arrow 1 at the end of a dash-dot line indicates generally the paper path and direction of paper guidance through the printer. Feeding may involve single sheets such as 17 or an endless sheet such as 16. As can be seen specifically, the feeder path for sheet stock is split owing to the fact that single sheets (17) and an endless sheet (16) come from different stores and sources. Accordingly, the dash-dot line ending in arrow 1 has two branches on its upstream side denoting the two feed paths.

Reference numeral 2 generally refers to a printing platen which is of non-circular cylindrical configuration. The printing platen is preferably configured as a sound attenuated platen bar. Reference number 2a refers schematically to a matrix print head which runs, for example, along the platen 2 in a direction transversely to the plane of the drawing of FIG. 1. The constructions and details of the print head and of the carriage for the print head are understood to be conventional.

For single sheet feeding, a feed side friction roller pair is provided being comprised of the two rollers 13 and 14. They are accordingly arranged upstream from the platen 2. Also upstream from the platen 2 is arranged a thrust or pushing tractor 15 which positioned horizontally so that the endless sheet 16 is advanced in the horizontal. That feed path merges with a curved path 22, and the sheet 16 is veered in up direction so as to pass in the vertical through the print area as defined in platen 2 and head 2*a*. The single sheet path is more curved and merges with the endless sheet feed path in that curved path portion 22.

A second roller pair or downstream roller pair is comprised of rollers 11 and 12. This downstream exit or discharge roller pair is used in common by single sheets 17 as well as by endless sheets 16. It is now an important aspect of the invention, that the pressure forces provided by the roller pair 11 and 12, on one hand, and by the roller pair 13 and 14, on the other hand, have a fixed particularized relationship. A prerequisite for fulfilling this relational requirement is that one of the friction rolls of each pair which is 11 for the downstream pair and 14 for the upstream pair are journalled in stationary journals 2c in the printer frame 2*b*. The respective other friction roll i.e. 12 and 13 are removable in the sense that a certain spatial separation between the rollers of each pair can be provided while, on the other hand, each of these movably mounted rollers 12 and 13 can be urged against the respective stationarily journalled friction roller (11 and 14) by means of a particular pressure force whereby these pressure forces bear fixed relation to each other.

In order to achieve the aformentioned objective, a feed side or upstream roller mounting and journalling lever 4 is provided for mounting and journalling the roller 13, while a downstream or discharge mounting and journalling roller lever 3 is provided for mounting and journalling the roller 12. Lever 4 is pivotally mounted in pivot mount 2*d* being connected to frame 2*b*. The downstream roller mounting lever 3 rests on a support 7 with the roller 11, 12 engage. Lever 3 is pivoted on the axis of a shaft 8 and an intermediate lever 3*a* is also connected to shaft 8. The intermediate lever 3*a* is pivotally mounted to the frame 2*b* by means of pivot mount 2*e*. Downstream lever 3 as stated carries the thus adjustibly positioned friction roller 12, and upstream roller mount lever 4 carries the friction roller 13.

Lever 3 is connected through a cam section piece 8*a* to the shaft 8. Shaft 8 runs parallel to the platen 2 and cam section 8*a* is of D-configuration. Shaft 8 itself is rotatably mounted in sleeve 30, which sleeve, in turn, is secured in the intermediate lever 3*a*. Thus, lever 3*a* pivots on 2*e* which is a frame journal and lever 3 pivots on lever 3*a* through shaft 8. The lever 4 bears against the sleeve 30 and maintains that engagement upon turning of the shaft 8 about 2*e* via 3*a*. This turning or pivoting is effected by the force of a spring 5. Since, as stated, the lever 3*a* is pivotably mounted in frame 2*b*, it can be so pivoted in the pivot bearing 2*e*.

Lever 3*a* carries a U-shape spring 10; one of the legs, namely leg 10*a* of that spring is fastened to the intermediate lever 3*a* itself, the other leg of the spring, 10*b*, bears against a lever 9 and resiliently biases the lever. The resiliently biased lever 9 is secured to the shaft 8 and moves therewith. Moreover, intermediate lever 3*a* is in addition provided with a fastening point 3*b* for the tension spring 5. The other end of spring 5 is fastened at point 4*a* to the lever 4. Hence, spring 5 exerts a force which acts as torque for the lever 4 about the pivot bearing 2*d* of that lever to thereby urge the friction roller 13 towards and against the stationarily mounted friction roller 14.

Figure 2:
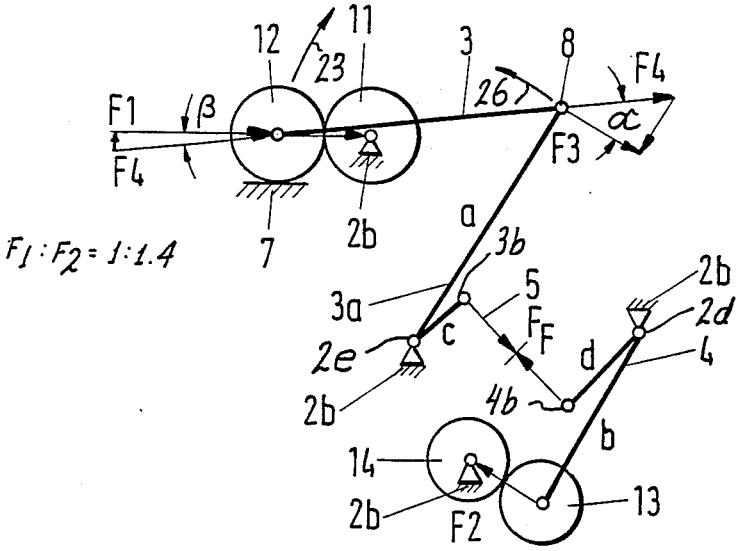
FIG. 2 is a vector and schematic lever diagram for the various forces as they are effective in kinematically and dynamically coupled friction roller pairs used in the arrangement shown in FIG. 1.

Turning now to FIG. 2, it should be mentioned that this figure shows the two friction roller pairs in the same spatial orientation in which they are shown in FIG. 1. The same is true with regard to the various levers which however are indicated only schematically so as to facilitate the illustration of the various forces acting on various elements. Specifically, there is a first pressure force F1 that acts between the rollers 11 and 12 and a pressure force F2 which is effective between the rollers 13 and 14. These forces are in affect adjusted by and through the various distances a, b, c, and d, defining lever lengths. These distances are adjusted (selected) in addition to the selection of the force F of spring 5 so that F1:F2 has about a ratio of 1:1.4.

A typical example in a matrix printer are the following values which yield this result. Angle alpha is 46.5 degrees; angle beta is 6 degrees, a=46.3 millimeter, b=32.6 millimeter, c=12 millimeter and d=17.7 millimeter. The effective forces moreover, result now from the fact that the friction rollers are configured as follows. The rollers 11 and 14 are provided with a rubber layer, specifically indicated as 11*a* for roller 11 and 14*a* for roller 14. The rollers 12 and 13 are made of steel but carry a knurling such as 12*a*, shown for roller 12 and 13*a* for roller 13. In addition, the friction is adjustable in that all of the rollers are driven.

Figure 3:
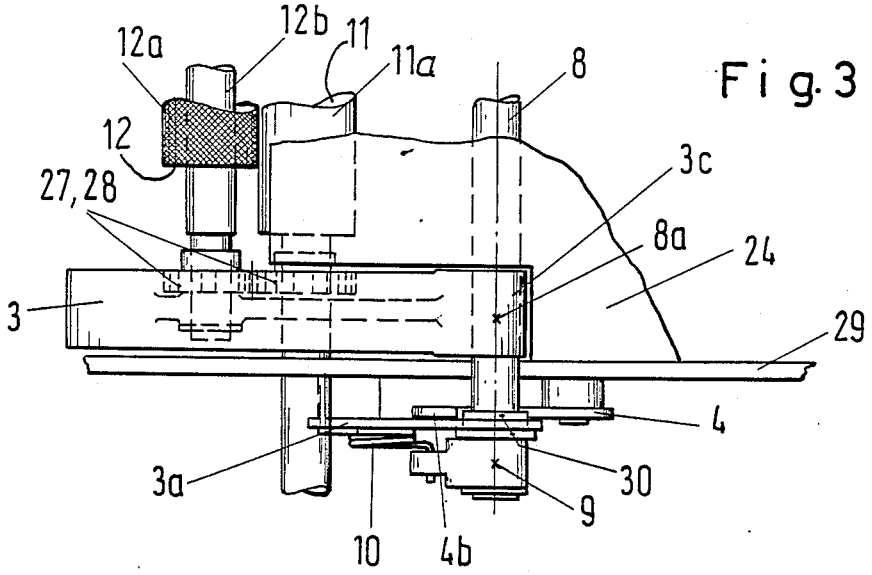
FIG. 3 is a top elevation of one side of the paper transport device shown in FIG. 1.

After having described the general layout and some effectiveness of the arrangement in accordance with the preferred embodiment of the invention, we turn now to details of certain construction features. FIG. 3 illustrates particularly and in greater details the downstream roller support lever 3 as it is mounted on shaft 8. Also shown is the resiliently biased lever 9. In fact, these elements 3, 8 and 9 together constitute a rigid unit in the sense that these parts move in unison; the resilient bias of lever 9 is transmitted to 8 and 3 by operation of this rigid connection.

During pivoting of lever 3 in direction 23 (FIG. 1) a cam 3*c* is urged against the protection of the platen carrier 24. This has the effect of a toggle lever-like action. The intermediate lever 3*a* is pivoted on and in its pivot mount 2*e* in the frame 2*b*. Concurrently then, shaft 8 is moved in direction of arrow 26 (FIGS. 1 and 2), i.e. the upstream roller support lever 4 is moved as a whole in direction 26 about pivot mount 2*e* in the frame 2*b* so that the friction roller moves also away from the friction roller 14. Upon up pivoting sleeve 30 bears against an extension 4*b* of the lever 4. The downstream lever 3 in turn can be pivoted up until engaging an abutment 31 of the lever 9.

Figure 4:
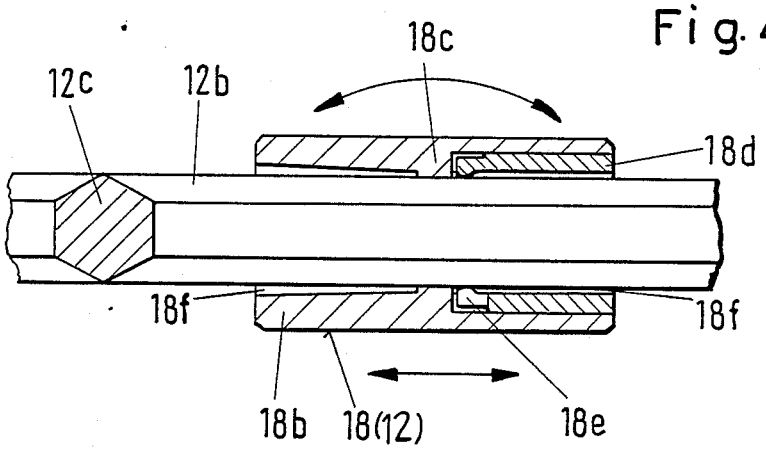
FIG. 4 shows in detail a shaft construction, on an enlarged scale and in cross-section.

In lieu of a steel roller with knurled surface, e.g. 12*a*, one can use a roller (18) made of synthetic material. This roller configuration is shown in greater detail in FIG. 4, in which the roller 13 is actually replaced by the synthetic material roller 18. That roller 18 is arranged in relation to a drive shaft 12*b* to be articulated axially and to be also movable in axial direction. For this, shaft 12*b* is provided with a polygonal cross-section indicated by 12*c*. The roller body 18*b* is provided with an intentional ridge 18*c* which, as seen in radial direction, is positioned in the center of the roller body. A resilient ring 18*d* being also made of synthetic material is associated with that ridge 18*c*. This way roller body 18*b* can swing inside of the hollow space 18*f* by operation of resilient arms 18*e*.

The paper transport device as described in the foregoing operates as follows.

The downstream friction of roller pairs 11 and 12 has two tasks. First of all, it tensions a single sheet 17 and engages an endless sheet 16 (of course, there is only one at a time). Whatever paper is chosen, this roller pair 11 and 12 transports the respective sheets following disengagement either from the upstream friction roller pair 13 and 14 or from the tractor 15 and thereby moves the respective sheet out of the printer. In addition, the rollers 11, 12 avoid the formation of "waves", bulges or bunching and of the respective sheet; for this, downstream friction roller pair 11 and 12 has a speed of rotation so that its linear speed is larger by 2/10 of 1% than the linear speed in any instance either of the tractor 15 or of the upstream friction roller pair 13 and 14. This accumulated excess in propagation is compensated by a certain amount of frictional slippage of the downstream roller pair 11 and 12 on the paper. Note that friction forces of the downstream roller is smaller than the friction exerted by the upstream roller pair. The excess, of course, is quite small, so that the paper transport device is capable of retracting for example, a complete A-4 type page (having a length of 297 millimeter) without any interference.

The upstream friction pair 13 and 14 determines generally the path that is being traverse by the paper in any instant. It is for this reason that the friction force exerted by this roller pair is larger than the friction for exerted by the roller pair 11 and 12. This effect obtains also through rubber coating of roller 14 and the knurling of roller 13 and by having the friction roller 11 also carry a rubber layer roller 12 could be replaced by two or more smooth surface synthetic roller 18. The chosen lever lengths as given by a, b, c, and d as well as the choice of the angles for alpha and beta make sure that the friction force of the downstream roller pair 11 and 12 remains always smaller than the friction force exerted by the upstream roller pair 13 and 14.

Thrust or pushing tractor drive 15 may cause problems when, in fact, plural layers for forms or the like are to passed through the printer. This may particularly result from the curving 22 but it is apparent that at some point a certain curvature or curving in the paper transfer path is necessary. Such a curvature produces a slight path difference between the radial innermost and the radial outermost paper sheet of a small stack. It is for that reason only the friction roller 11 with its rubber layer 11a provides directly frictional engagement with the paper while the synthetic roller 18 or a knurled roller has merely guiding and capstan-like functions. The smooth surface of a synthetic roller 18 exert hardly any frictional force upon the paper. Still, the shaft 12 is driven in order to compensate any breaking affect frictions may have in several bearings. Therefore, the first layer of paper is not retarded by the roller 18 but that could lead to the formation of waves and may result in paper bunching. If, in particular difficult cases, such as an unusual paper surface bunching does still occur, here then, the roller pairs 11 and 12, and 13 and 14, can both be manually opened up through pivoting the downstream roller lever 3.

As the lever 3 is lifted in the direction 23, shaft 12*b*, on one hand, and intermediate lever 3*a*, on the other hand, are likewise pivoted so that the spring 10 is compressed against it force and the spring biased lever 9 is pivoted in direction 23*a*. The shaft 12*a* now is articulatedly turned and by operation of D-profile section 8*a* or shaft 8. Upstream roller support lever 4 is likewise pivoted about its pivot mount 2*d*. Pivoting occurs such that the roller 13 is lifted off the roller 14.

Upon lifting the lever 13, mounting roller 12 (or 18), gears 27 and 287 disengage. These gears transmit the driving force for rollers 12 or 18 and are arranged within the frame side wall 29. Gears such as 27 and 28 are, in fact, also on the shafts driving the friction rollers 13 and 14. Upon lifting up lever 3, the cam 3*c* is pivoted against the platen carrier 24 such that the open angle 25 (FIG. 1) closes. This results in an articulation effect, as stated, and being effective between the lever 3 and the intermediate lever 3*a* in the sense that the shaft 8 becomes, in effect, a hinge axis. Consequently, lever 3*a* is pivoted in and around pivot mount 2*e* in frame 2*b* which is underneath the spring 10. The pivot motion in the direction 26 leads, as was mentioned earlier, also to pivoting of the lever 4 about its pivot 2*d* in the frame 2*b* which occurs to the right and via the spring 5.

The invention is not limited to the embodiments described above, but all changes and modifications thereof, not constituting departures from the spirit and scope of the invention are intended to be included.

We claim:

1. Paper feeder for printers which include a print platen mounted in a frame, comprising in combination:

a first friction roller pair for single sheet feeding arranged upstream of the platen with respect to paper flow past the platen;

a thrust or pushing tractor for feeding endless sheet material towards the printing platen and likewise arranged upstream from said printing platen and operationally in parallel to said first friction roller pair;

a second friction roller pair for both single sheets and endless sheets and being arranged downstream from the printing platen with respect to paper flow;

one roller of each pair being journalled in said printer frame for rotation thereon;

a first pivot lever for mounting the other roller of the first pair;

a second pivot lever mounting the other roller of the second pair; and spring-biased linkage means interconnecting the first and second levers such that the pressure of the roller on the first lever against the one roller of the first pair is consistently larger than the pressure of the roller on the second lever against the one roller of the second pair.

2. Paper feeder as in claim 1, said linkage means including spring means for biasing the second lever.

3. Paper feeding as in claim 1, said linkage means including a spring-biased intermediate lever for mounting the second lever, and a coupling spring interconnecting the intermediate lever and the first lever.

4. Paper feeder as in claim 1, said second lever abutting a stop when urging the roller it carries against the one of the first pair, the stop oriented at right angles to a direction between axes of the rollers of the first pair.

5. Paper feeder as in claim 1, the other roller of the second pair being mounted on an articulated drive shaft permitting also axial displacement.

6. Paper transport as in claim 6 wherein one roller of each pair is covered with rubber, the other one being a synthetic roller with a smooth surface.

7. Paper transport as in claim 1 wherein one roller of each pair is covered with rubber the other one is a knurled steel roller.

8. Paper transport as in claim 1 wherein all rollers are driven.

9. Paper feeder as in claim 1, pivot axes of the levers are parallel to the platen.

* * * * *